US005443102A

United States Patent [19]

Svendsen

[11] Patent Number: 5,443,102

[45] Date of Patent: Aug. 22, 1995

[54] METHOD AND APPARATUS FOR FILLING PARTICULATE MATERIAL INTO A LINER OF A FIBC

[75] Inventor: Jens Svendsen, Hosle, Norway

[73] Assignee: Norsk Hydro a.s., Oslo, Norway

[21] Appl. No.: 187,005

[22] Filed: Jan. 27, 1994

[30] Foreign Application Priority Data

Jan. 27, 1993 [GB] United Kingdom ..... 9301635

[51] Int. Cl.[6] ..... B65B 1/04; B65B 3/04

[52] U.S. Cl. ..... 141/10; 141/93; 141/290; 141/314; 141/317; 53/479

[58] Field of Search ..... 141/10, 11, 12, 68, 141/93, 114, 166, 290, 313, 314, 315, 316, 317; 53/479, 371.5, 374.5

[56] References Cited

U.S. PATENT DOCUMENTS

| | | | |
|---|---|---|---|
| 1,003,006 | 9/1911 | Maxwell | 141/316 |
| 3,498,344 | 3/1970 | Schwake et al. | 141/317 |
| 3,914,917 | 10/1975 | Young | 53/479 |
| 4,049,028 | 9/1977 | Harris et al. | 141/93 |
| 4,182,386 | 1/1980 | Alack | 141/93 |
| 4,420,021 | 12/1983 | Strand et al. | 141/10 |
| 4,727,913 | 3/1988 | Bliss | 141/93 |
| 4,866,914 | 9/1989 | Moribe | 53/479 |

FOREIGN PATENT DOCUMENTS

| | | |
|---|---|---|
| 0118112 | 9/1984 | European Pat. Off. . |
| 1095789 | 12/1967 | United Kingdom . |
| 1475019 | 6/1977 | United Kingdom . |

*Primary Examiner*—Robert M. Fetsuga
*Assistant Examiner*—Steven O. Douglas
*Attorney, Agent, or Firm*—Wenderoth, Lind & Ponack

[57] ABSTRACT

A method for filling an FIBC includes causing particulate material to flow from a container under gravity through a filling duct into a liner of the FIBC. The particulate material is caused to adopt a free fall generally laminar flow stream which over substantially all of its length does not contact the wall of the filling duct. Accordingly formed adjacent such stream is an air passage through which passage at least part of air displaced from the interior of the liner by the particulate material can escape without significantly disrupting the flow of particulate material.

21 Claims, 3 Drawing Sheets

METHOD AND APPARATUS FOR FILLING PARTICULATE MATERIAL INTO A LINER OF A FIBC

BACKGROUND OF THE INVENTION

The present invention relates to a method and apparatus for filling bags.

Fertilizers have recently have been distributed in large flexible walled containers which contain from 250 to 2000 Kgs or more of granular material. Typically, such containers comprise a woven or similar load-bearing outer bag, preferably incorporating lifting loops or other means by which the container can be lifted and handled before, during and after filling, and a moisture barrier inner liner within the load-bearing outer bag, within which liner the granular material is held and protected against the environment during transport and storage. Typically, the load-bearing outer bag is formed from one or more plies of a woven polyalkylene fiber and lifting loops are formed integrally at the open top of the bag, for example as described in European Patent No. 0118112. The inner liner is typically formed from a substantially water-impervious polyalkylene or polyvinylic sheet material which provides a weather-resistant envelope for the contents, the liner being supported by the outer load-bearing bag during lifting and handling of the container. Such a container is filled through the open top of the liner or through a filling tube formed as a narrow axial extension of the liner, and the container is closed by heat sealing or tying off the open top of the filling tube of the liner.

Many forms of such container have been proposed, and for convenience, the term FIBC will be used herein to denote such containers in general. Furthermore, such FIBCs find use in the transport and storage of a wide range of particulate materials, for example cement, sugar, polymer beads and fertilizers. For convenience, the invention will be described hereinafter in terms of granular fertilizers having a predominant particle size in the range 1 to 4 mm. While FIBCs provide a cost effective means for storing and transporting fertilizers in comparatively large unit loads, typically from 500 to 1500 Kgs, problems are encountered in filling such containers. In view of the large tonnages which have to be handled in a commercial bag filling operation, it is desirable to fill the FIBC as rapidly as possible, typically within a total time span of less than 10 seconds so as to introduce the minimum of interruption in the flow of the FIBCs from introduction to the filling station to output of the filled and sealed bags. The conventional methods for filling small bags containing typically 50 Kgs have not proved feasible.

A fundamental problem resides in the fact that the filling tube or open end of the liner through which the material flows must be comparatively narrow, since it is difficult to achieve rapid heat sealing of the tube or open end if it extends for more than about 30 to 50 cms. However, in filling the FIBC, air is displaced from the liner and must escape through the filling tube in the opposite direction to the incoming particulate material. This problem is aggravated if the liner of the FIBC has been pre-inflated with air, as proposed in GB A 1475019, to distend the liner prior to filling. Therefore, if the filling tube is narrow to reduce problems in sealing the neck, problems will arise in securing outflow of air from the liner as the air is displaced by incoming particles. As a result, it has been accepted that the speed of filling an FIBC is a balance between these conflicting needs, and the limiting factor is the need to release air from the liner during filling.

It has been found that if the stream of the in-flowing particulate material is caused to adopt a free falling substantially laminar flow through the filling tube of the FIBC, typically in the form a jet type of flow of the material, so as to form a gap, preferably an annular gap, between the stream of particulate material and the wall of the filling tube over substantially the length of the filling tube, this gap surprisingly permits the air to escape from the interior of the liner without significantly disturbing the free falling flow of the particulate material. As a result, air can vent freely from the liner as it is filled and the flow of the particulate material is not significantly impeded or disrupted by the escaping air, whereby the ideal free fall flow of the particles can be maintained and the maximum filling rate of the FIBC can be achieved. It has further been found that the filling tube can be narrower than has hitherto been considered necessary without affecting this laminar flow, so that heat sealing of the tube can be carried out more readily.

SUMMARY OF THE INVENTION

Accordingly, the present invention provides a method for filling an FIBC which comprises causing particulate material to flow from a container under gravity through a filling duct into the liner of the FIBC, wherein the particulate material is caused to adopt a free fall generally laminar flow stream which over substantially all of its length does not contact the wall of the filling duct. Thereby there is formed an air passage adjacent such stream, preferably between the stream and the wall of the filling duct, through which passage at least part of the air displaced from the interior of the liner by the particulate material can escape from the interior of the liner without significantly disrupting the flow of the particulate material.

The term laminar flow is used herein to denote that there is substantially no turbulence in the flow.

The particulate material can be caused to adopt a laminar flow having a wide range of cross-sections, for example a falling curtain of the particles from a slot or oval shaped outlet. However, it is preferred that the material is caused to adopt a substantially cylindrical laminar flow within a generally circular cross-section duct so as to form a generally annular gap between the flow and the duct wall through which substantially all of the displaced air can escape from the liner. However, it will be appreciated that part of the air may escape through a substantially central bore formed within a tubular type of flow of the solid particles, although in such a case it is still necessary that the flow of particulate material does not touch the wall of the duct to minimize turbulence in the flow or particles. For convenience, the invention will be described hereinafter in terms of a cylindrical type of particle flow pattern having an annular gap around the flow.

Preferably, the liner is provided with an axial filling tube into which is located a filling spout extending below the hopper or other container from which the particulate material is to be discharged, and the flow of particulate material does not contact the wall of the spout or the filling tube during its passage from the container to the interior of the liner. The term duct as used herein denotes both the spout and the filling tube through which the particulate material flows.

The hopper or other container is preferably one which discharges a predetermined amount of material into each FIBC, for example a known volume or weight of material, using conventional weighing or measuring techniques and equipment. Alternatively, the desired fill of the FIBC can be achieved by carrying the FIBC upon a surface incorporating means for detecting the weight or volume of material within the FIBC and using this means to operate a shutter to control the flow of material from a hopper. For convenience, the invention will be described hereinafter in terms of a conventional weigh box and bulk hopper which discharges a fixed weight of material to the FIBC at each actuation of a valve fitted at an outlet to the weigh box.

The required laminar flow in the duct is conveniently achieved by imparting a specific degree of convergent flow to at least part of the material flowing through the outlet from the weigh box feeding material to the FIBC and masking at least part of the access path to an orifice or opening of the outlet so as to prevent the flow of solids from filling the whole of the transverse cross-section of the outlet orifice. The convergent flow can be achieved by forming at least part of the entry to the outlet duct with converging walls, for example the outlet can be formed with tapered entry surfaces, by tapering a basal portion of the weigh box feeding material under gravity to the outlet, and/or by tapering the face of a valve or other flow restrictor or obturator which cooperates with the weigh box outlet orifice to regulate the flow of material through the outlet.

The valve or obturator also occupies part of the flow path into the outlet orifice and thus prevents the flow of solids through the outlet from occupying the whole of the transverse cross-section of the outlet. Alternatively, a fixed transverse plate may be located upstream of the outlet to mask the access path to the outlet. The masking means serves to prevent direct axial flow of the majority of the solid particles through the outlet so that the inclined surfaces can cause the convergent flow. The masking means preferably extends over from 50 to 150%, eg about 100%, of the transverse area of the outlet and is located upstream of the plane of the outlet by a distance which varies with the geometry of the inclined surfaces, the desired flow rate through the outlet and the nature of the solid particles. The optimum size and location of the masking means can be determined by trial and error for any specific application.

A particularly preferred method for achieving the laminar flow is the use of a valve plug located in the entry to the outlet with either or both the valve plug or the entry surfaces to the outlet being tapered to achieve the desired convergent flow. The plug can be fixedly mounted so as to provide, with the entry surfaces to the outlet, at least part of the tapered surfaces which guide the flow of the particulate material through the outlet and to provide the masking of the access path to the outlet, with a separate shutter to open and close the outlet. However, it is preferred that the plug be mounted so that its position can be adjusted axially and thereby vary the masking effect of the plug on the access path to the outlet and act as a throttle on the flow of material through the outlet. In a particularly preferred embodiment of the invention, the plug is provided as a close or tapered fit within the outlet orifice and is moveable axially from a position at which the plug closes the outlet to a position at which the plug and the entry surfaces to the outlet cooperate to form an annular orifice through which the desired flow is achieved. In this way, once the desired axial position of the plug for the free fall flow of the material has been determined, the axial movement between that position and the fully closed position can be duplicated repeatedly, thus facilitating interlinking of the operation of the plug with the filling and emptying cycles of the weigh box. If desired, the plug can be of hollow tubular form to allow some flow of air into the stream of solid particles as it leaves the downstream end of the plug, thus reducing the risk of turbulent flow within the particle stream at this point, and also to allow the air to escape from the FIBC where the flow of solid particles is in the form of a tubular flow.

In place of solid surfaces which guide the flow of the solid particles into the required laminar flow, it may be possible to form a mechanical equivalent of such a surface by allowing the particulate material in the base of the weigh box to form a static slope around the perimeter of the outlet. Such a slope adopts the angle of repose of the particulate material and effectively forms the desired taper at the base of the weigh box and, with the plug or other mask of the outlet access path, can achieve the desired laminar flow. However, it will be necessary to discard or adjust the initial fill from such a system, since part of the predetermined amount of particulate material to be discharged will be retained in the weigh box to form the tapered slope rather than being discharged to the FIBC.

The hopper, weigh box or other container having the outlet through which the particulate material is to be discharged to the FIBC can have any suitable plan cross-sectional shape, for example a square, rectangular or other polygonal shape. However, it is preferred that the outlet have radial symmetry, for example a generally circular cross-section, so that the particulate material is caused to adopt a substantially cylindrical jet flow within a circular cross-section filling tube discharging into the FIBC. To assist uniform flow through such an outlet, it is preferred that the hopper or weigh box have a generally circular plan cross-section with the outlet located substantially coincident with the axis of the hopper or weigh box.

As stated above, the flow of the particulate material is affected by the angle of the taper of the outlet wall or other surface over which it flows into the outlet. The specific angle of the taper which is required to achieve the laminar flow will vary from material to material and can readily be determined by simple trial and error tests for each material and hopper/weigh box configuration. However,, in general it has been found that satisfactory results will usually be obtained with angles of from 20° to 80° notably about 60°, for the included angle of the conical surface which the tapering surface describes. The taper may be a uniform taper as when straight surfaces are used. However, the taper may be progressive, as when a belled entry is provided to the outlet orifice, and the angles quoted herein denote the overall angle of the tapering envelope within which the convergence is contained.

The particulate material flowing through the outlet forms the desired laminar flow stream which falls under gravity into the interior of the FIBC liner. The flow is typically via a nozzle spout extending from the outlet from the weigh box, which spout extends into the axially extending filling tube of the liner of the FIBC which is commonly present with conventional designs of FIBC. The flow does not contact the wall of the spout or the filling tube over any appreciable extent of its length, so as to form an annular gap around the falling material. This gap provides the air passage by which air within the liner can escape as it is displaced from the liner by the incoming particle solids. The transverse dimensions of the gap will depend upon the rate at which the air is to escape from the liner.

The escaping air can vent into the weigh box, for example at least in part through the hollow stem of the valve plug, or can be vented at any other point after it has left the liner. However, it is preferred that the air be vented as soon as possible after it has left the liner or filling tube extension thereof so as to minimize the risk that it may disrupt the smooth flow of the particulate material. It is therefore preferred to provide an air vent chamber intermediate the outlet to the weigh box and the inlet to the filling tube of the liner. Conveniently, this air vent chamber is provided as an enlarged diameter section of the filling duct extending from the base of the weigh box and carries the axially extensible filling spout which is to be inserted into the filling tube of the liner. If desired, this chamber can be provided with a flap or other valve to close off the inlet to the chamber from the weigh box and thus allow air under pressure to be fed into the liner to distend the liner prior to feeding solids into the liner when the flap valve is opened. If desired, the air outlet from the chamber can be provided with a suction pump to assist removal of the air from the chamber. The operation of the air pressurization and the venting of air from the chamber can be interlinked with the operation of the valve in the outlet to the weigh box using conventional control systems.

The optimum dimensions for the various components of the filling flow and air vent paths can be readily determined by simple trial and error tests having regard to the weight or volume of material to be filled in a given time through a tube of specified diameter. If desired, the surfaces over which the particulate material and the air flow can be polished and/or given a low friction surface, for example a coating of a polytetrafluoroethylene polymer, to aid smooth flow thereof.

Accordingly, from another aspect, the present invention provides apparatus for filling fluent particulate material into an FIBC, which apparatus comprises:

a. means for discharging the material through an outlet to a duct for feeding the discharged material into the liner of the FIBC;

b. the outlet and/or the surfaces adjacent the outlet over which the material flows into the outlet are provided with one or more surfaces which are convergently inclined to the overall line or direction of flow of material through the outlet; and c. means are provided upstream of the outlet which co-operate with the said inclined surfaces and which mask part of the access flow path to the outlet an included angle of a cone formed by the convergent surfaces and the position of the masking means being selected so as to cause the particulate material to adopt a free falling flow of material which does not directly contact the walls of the duct over substantially all of its passage through the duct so as to form an air passage through which air can escape from the liner without significantly disrupting the flow of the solid material.

Preferably, the apparatus includes means for measuring a predetermined amount of the material, which means has a tapered base to provide the inclined surfaces in the entry to the outlet through which the particulate solid is to flow. It is further preferred that the masking means be provided by an axially moveable plug member which is adapted to cooperate with the tapered base to achieve the desired laminar flow through the outlet and to regulate the flow of material through the outlet.

As indicated above, the invention finds especial use in filling FIBCs with a granular fertilizer. In such application, it is desirable that the liner be sealed so that the fertilizer is protected against weather for storage and transport. This can be achieved by tying off the filling tube which extends axially from the liner. However, this is labor intensive, time consuming and cumbersome. It is therefore preferred that this tube be sealed by applying a heat seal across the tube. While the tube can be heat sealed using a conventional heat sealer bar, this requires that the FIBC be substantially stationary during the sealing step, which may take several seconds. This step will therefore introduce a further delay in the transit of the FIBC through the filling and sealing stations, notably where the sealing station immediately succeeds the filling station and where the sealing time exceeds the time taken to fill the FIBC.

It has been found that this delay can be minimized by the use of a sealing mechanism in which the heated sealing surfaces move with the moving FIBC as it is transported through the sealing station.

Accordingly, from a preferred aspect, the present invention provides a method for filling and sealing an FIBC, characterised in that the FIBC is filled using the free fall flow method of the invention and the filling tube or open top of the liner of the filled FIBC is subsequently heat sealed by means of a mechanism in which members applying heat and/or pressure to cause sealing of the material of the filling tube or open end travel with the FIBC through the sealing station, whereby the forward travel of the FIBC is substantially uninterrupted during the sealing operation.

The sealing is preferably carried out by applying heat to the material of the filling tube of the FIBC liner so as to cause fusion thereof to form a transverse heat seal. The heat can be applied by a heated belt or roller member which applies both the heat and the pressure required to form the seal. Preferably, such a belt or roller member cooperates with a similar member located in opposition to the first member with the material of the filling tube passing therebetween. Thus, for example, the filling tube can be passed through the nip of one or more pairs of heated and spring loaded rollers. However, it is preferred to provide the moving heat sealer surfaces as the opposed faces of two moving bands, notably flexible metal or other bands having apertures therein through which hot air is blown to cause at least partial fusion of the filling tube as it passes through the nip between the opposed faces of the belts. If desired, the cooperating faces of the heat sealer members can carry axial or transverse ribs to apply localized pressure to the liner material and the sealer members can be spring or otherwise biassed together with a pre-determined force to assist gripping and sealing of the filling tube.

It will be appreciated that the heat can be applied as an initial step to cause at least partial fusion of the liner wall material and pressure subsequently can be applied to the hot material to complete formation of the seal. Thus, for example, the top of the filling tube or liner can be held and transported through the sealing station by an opposed pair of transport belts which grip the liner or filling tube in a nip therebetween. A hot air stream, for example from one or more pairs of opposed fishtail nozzles, is directed onto the exposed liner wall or filling-tube extending above the transport belts to cause at least partial fusion of the wall or tube material. The heated material is then passed through the nip of one or more opposed rollers or belts to apply pressure to the heated material and complete the formation of the heat seal. As indicated above, the pressure belts may have apertures therein whereby hot air can also be passed through the apertures onto the heated material to maintain its elevated temperature during the application of pressure. Furthermore, the transport and/or pressure application rollers or belts can carry transverse and/or axial raised ribs or the like to apply localized elevated pressure to the material as it passes through the sealing station.

The use of the combination of the filling method of the invention and the moving heat sealer members enables an operator to minimize the disruption in the movement of an FIBC through the filling and heat sealing stations so that these operations can be carried out within a minimum time span. Furthermore, both operations readily lend themselves to automated operation, thus reducing the number of operators required to handle the FIBCs as they pass through the filling and heat sealing operations.

DESCRIPTION OF THE DRAWINGS

To aid understanding of the invention, a preferred form thereof will now be described with respect to the accompanying drawings in which.

DESCRIPTION OF THE PREFERRED EMBODIMENT

Figure 1:
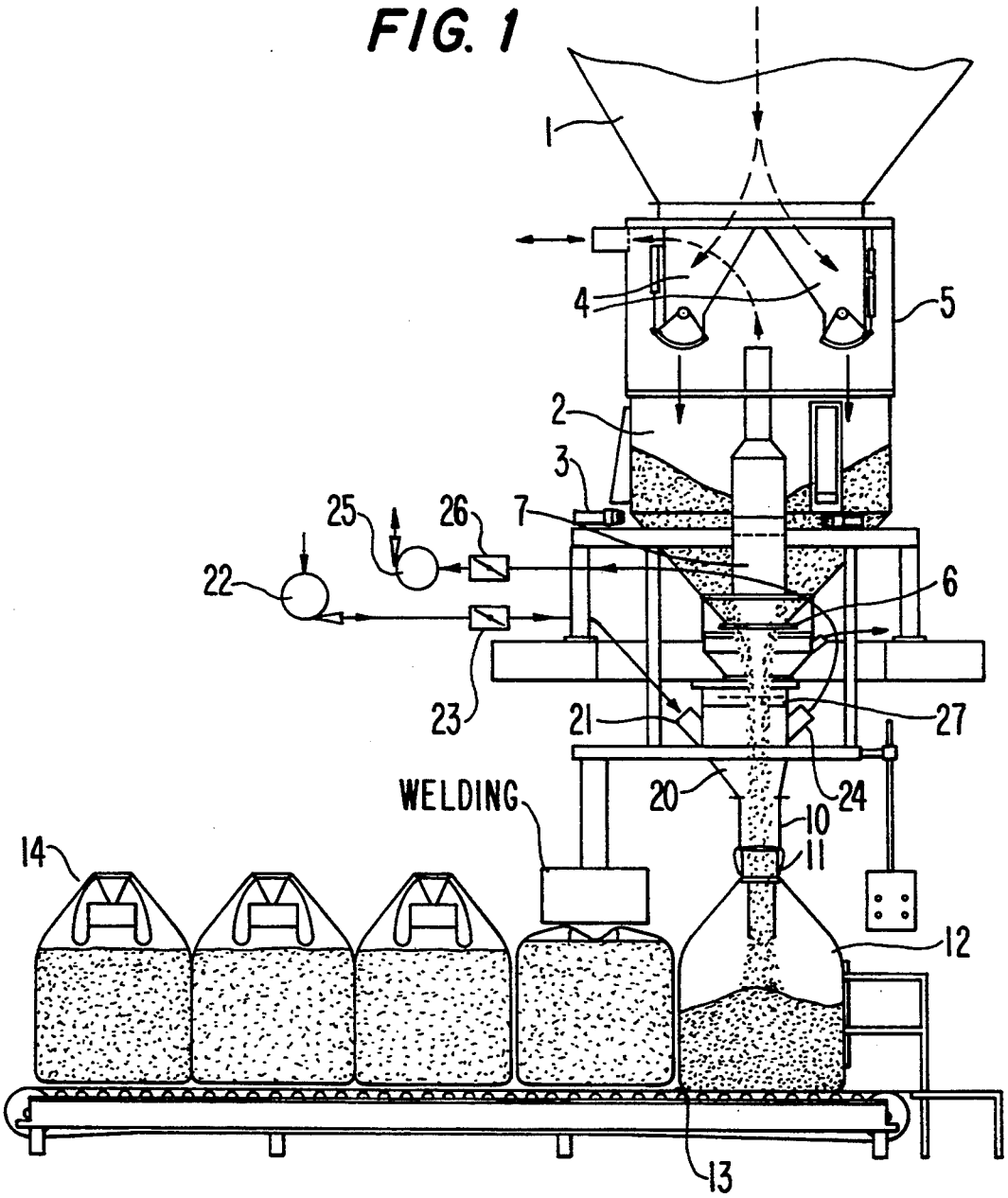
FIG. 1 is a diagrammatic side elevation of a combined filling and heat sealing station.

A storage hopper 1 for particulate material is situated above a weighing box 2 provided with a strain gauge or other weighing means 3. The hopper 1 is provided with multiple outlets 4 to achieve uniform distribution of material fed to the weighing box 2. The area between the weighing box 2 and the hopper 1 is encased in a mesh screen 5 so as to allow air to escape from the weighing box 2 as it is filled from hopper 1, while retaining dust. This arrangement uses conventional design and construction techniques and enables fast filling of the weighing box 2 to be achieved while allowing an exact measurement to be achieved near the end of the filling cycle by shutting off one or more of the outlets 4.

Where a platform, conveyor or other means carrying a FIBC through the filling step incorporates a weighing means so that a valve plug or body 7 is lowered to shut off the flow of material from the hopper 1 when the FIBC has received a desired weight of material, the weigh box 2 may be dispensed with and material discharged directly from the hopper to the FIBC.

The base of the weighing box 2 is formed with a taper leading to an outlet 6 for discharging material from the weighing box 2 via a filling spout 10 extending axially into a filling tube 11 of the liner of an FIBC 12. Axial cylindrical valve body 7 is mounted inside the weighing box 2 to co-operate with the outlet 6 and the taper of the base of the weighing box 2 to provide a masking member which causes material flowing through the outlet 6 to adopt a laminar free falling flow stream as shown. The valve body 7 and the outlet 6 are preferably of circular cross-section and the upper part of the valve body 7 extends axially to above the level of the fill of material in the weighing box 2 as shown. The foot of the valve body 7 can be sharply cut off transversely as shown, or can be formed with a taper which cooperates with the taper in the base of the weighing box 2 to achieve the desired convergent flow as the material passes through the outlet 6. The valve body 7 is of substantially the same cross-sectional shape and size as the outlet 6 so that valve body 7 closes the outlet 6 when the valve body 7 is lowered to seat into the outlet 6.

The angle of the taper of the base of the weighing box and/or the valve body 7 and the axial position of the valve body 7 relative to the outlet 6 are determined by the characteristics of the particulate material and are selected so as to achieve free and steady flow of material through the orifice 6 into the filling spout 10 without touching the inner wall of the spout. The included angle of the cone formed at the tapered base of the weighing box 2 will usually lie in the range 40° to 80°, preferably about 60°, which is well suited to the flow characteristics of granular fertilisers and similar materials. It is not necessary, as shown in FIG. 1, for the foot of the valve body to be tapered; and where the valve body 7 is tapered, it is not necessary for the taper on the base of the weighing box 2 and the foot of the valve body 7 to be the same, provided that they co-operate to achieve the desired laminar flow.

The valve body 7 can be fixed axially so as to provide a fixed flow path for material to and through the outlet 6, in which case a shutter or other valve means (not shown) will be required to regulate the flow of material through the outlet 6. However, it is preferred that the valve body 7 can be raised or lowered axially, thereby controlling the masking effect it has on the flow of material through the outlet 6 and the rate of flow of material released from the weighing box. In its lowermost position, the valve body will close the outlet to allow the weighing box 2 to fill with the desired weight of material; in its upper position the valve body co-operates with the slope of the lower part of the weighing box 2 to achieve the desired laminar flow to achieve maximum flow rate of material into the FIBC 12. The upper position can be adjusted to suit different materials, for example by setting one or more stops on the travel of a hydraulic ram raising and lowering the valve body. Once ascertained, this upper position can be repeatedly achieved so that the operation of the weighing box 2 and the valve body 7 can be carried out automatically.

The outlet orifice formed between the valve plug 7 and the tapered base of the weighing box 2 will be in the form of the annular gap between the lip of outlet 6 and the foot of the valve body 7. The radial dimension of this gap will give the correct form and dimensions to the free falling stream of particles. The diameter of the filling spout used to feed material from the outlet 6 into the FIBC also affects the filling rate which can be achieved. Once this has been established from the desired operating parameters of the apparatus, the diameter of the annular gap between the valve body 7 and the rim of the outlet 6 is adjusted so that a free and steady flow of the particulate material through the filling spout is achieved without the material physically contacting the inner walls of the filling pipe. Further adjustments to the flow may be made to obtain a satisfactory distance or clearance between the flowing stream of particles and the wall of the filling spout to allow air to escape from the FIBC via the annular gap around the stream of particles. The optimum dimensions and flow rates can readily be established by trial and error tests for any given case.

A case 20 encloses and protects the base of the weighing box 2 and the outlet 6 and carries the upper part of a telescopically adjustable filling spout 10 which extends into the filling tube 11 of the FIBC 12. The case 20 is provided with an air inlet 21 connected to a source of pressurised air 22 which is used to inflate the liner of the FIBC prior to filling. Preferably, a control valve 23 regulates the flow of air through the filling spout 10. The case 20 is also provided with one or more air outlets 24 and these may be connected to suction means 25 via a control valve 26. Case 20 is also provided with a closure plate or flap 27 at its upper end adjacent the outlet 6 of the weighing box. This plate 27 is pivoted between a closed position when the weighing box is being filled so that mechanical disturbance of the weighing from the lower parts of the filling system is minimized. When plate 27 is pivoted to the open position, it does not interfere with the free flow of material through outlet 6 into the filling spout 10 and also closes off the air flow to inlet 21, thus causing air escaping from the liner 12 into the chamber within case 20 to vent through outlet 24.

In operation, an FIBC is placed on a platform, for example a conveyor 13, which transports the FIBC through the filling and sealing stations. The conveyor 13 can be a conventional belt or slatted conveyor which supports the base of the FIBC. Preferably, the FIBCs are in contact with one another to provide lateral support to each other and so that the conveyor 13 can be set to move by increments of one FIBC's width in transporting the FIBC through the filling and sealing stations. If desired, a raised chain or similar conveyor can be provided which carries cups or other means by which the filling tube 11 of the FIBC is supported. It has been found that once the FIBC has been inflated with air, there will usually be no need for additional support for the upper end of the outer bag of the FIBC by means of hooks or the like before or during filling. However, the outer load-bearing bag of the FIBC may be provided with pre-formed lifting loops 14, which are biassed to adopt a raised position so that they are accessible when filling and sealing is completed and the container is ready for further handling. This also permits the use of a moving belt heat sealing unit as described below, into the nip of which the filling tube 11 of the liner can be readily fed to achieve heat sealing of the filling tube 11 after the FIBC has been filled.

Figure 2:
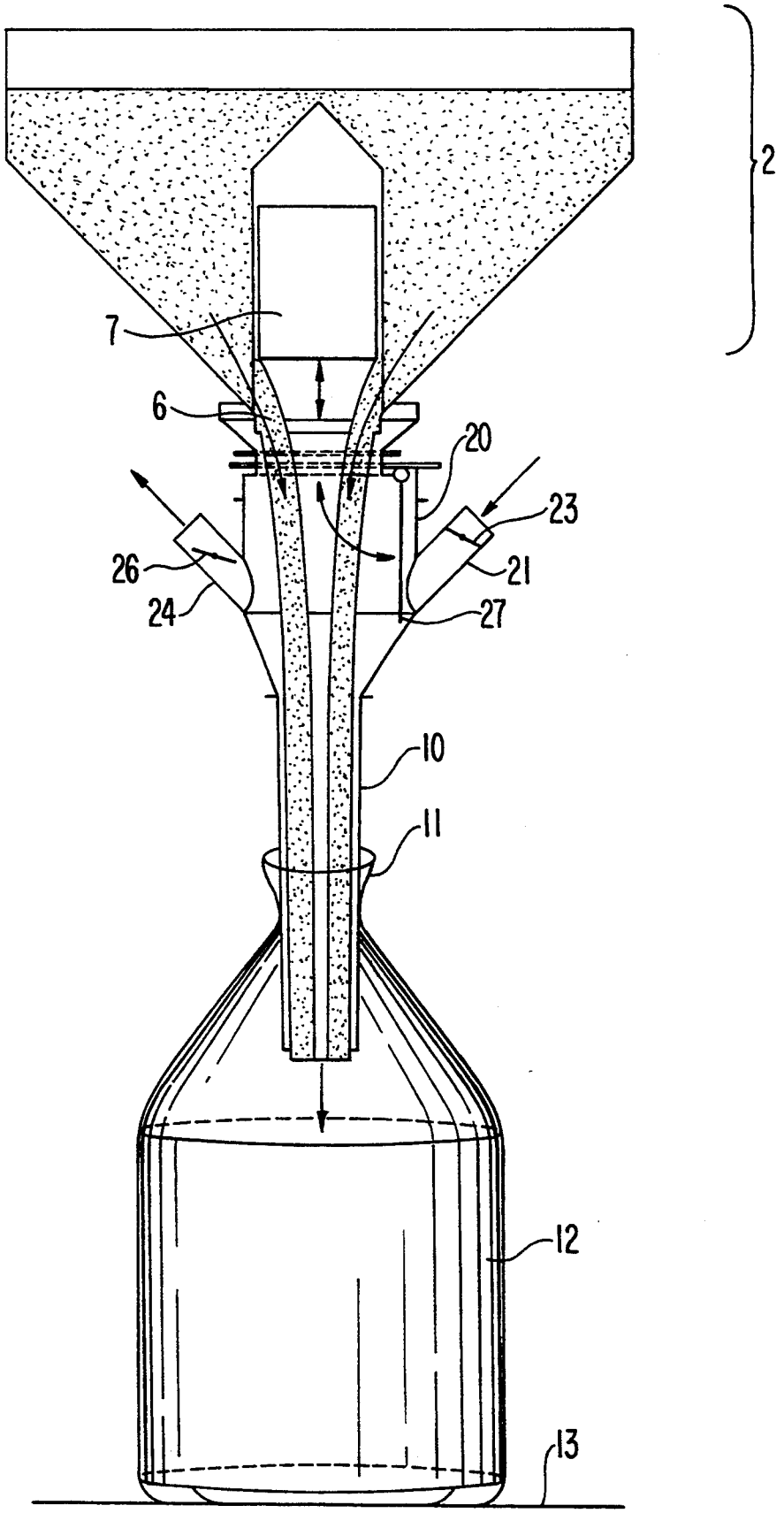
FIG. 2 is a detailed partial cross-sectional view of a filling apparatus employed in the station of FIG. 1.
Figure 3:
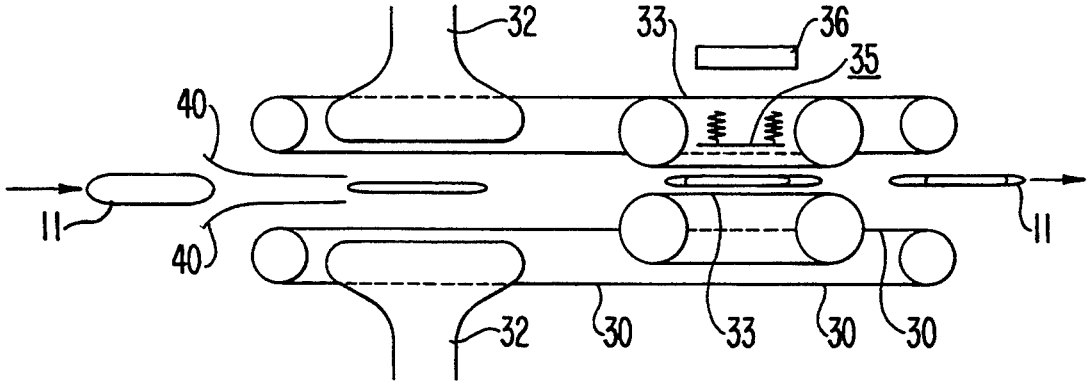
FIGS. 3 and 4 are diagrammatic horizontal and transverse sectional views respectively of a heat sealing apparatus employed in the station of FIG. 1.

The filling tube 11 of the liner is attached, for example by hooks or as a friction fit, onto the axially extending feeding spout 10 carried by the base of case 20. Flap 27 is pivoted to the raised position as shown in FIG. 1 and air under pressure is fed by pump 22 via inlet 21 in case 20 into the liner so that it is 12 so as to distend the liner ready for filling with granular fertilizer from weighing box 2. Fertilizer is fed under gravity from hopper 1 via the multiple outlets 4 into the weighing box 2 until the desired weight of fertilizer has been achieved. The outlets 4 are closed, flap 27 is pivoted to the lowered position as shown in FIG. 2, inlet 21 is closed off and outlet 6 is exposed to case 20 and spout 10. Valve body 7 is then raised to the desired extent to allow the fertilizer to flow from weighing box 2 through outlet 6 into spout 10 and filling tube 11. The position of the valve body 7 required to co-operate with the slope of the base of weighing box 2 to achieve a laminar flow of the fertilizer through the spout and filling tube without touching the walls thereof has been previously determined. Such a flow forms an annular gap around the flow of particles through which air can escape from the liner into the chamber within case 20 and then through outlet 24 under the influence of suction pump 25.

Once the FIBC has received the desired charge of fertilizer, the filling tube 11 of the filled FIBC 12 is disconnected by an operator from the filling spout 10 of the filling station and the FIBC is carried by conveyor 13 to the sealing station 18. Alternatively, the filling and sealing mechanisms can be mounted on a carousel or other rotating support so that these mechanisms can be brought into and out of register with the FIBC which remains static.

As indicated above, the filling tube 11 of the FIBC 12 can be tied off or heat sealed to close the FIBC and protect the contents of the liner from moisture, etc. However, if a conventional impact heat sealer is used, this must complete the formation of the heat seal during the time required to fill an FIBC if the heat sealing step is not to introduce an interruption into the forward travel of the FIBC. In practice, it has been found difficult to achieve a satisfactory seal in such a short time. It is therefore preferred to heat seal the filling tube 11 by means of a moving belt/roller type of heat sealer in which the sealing surfaces of the sealer mechanism travel with the FIBC.

Figure 4:
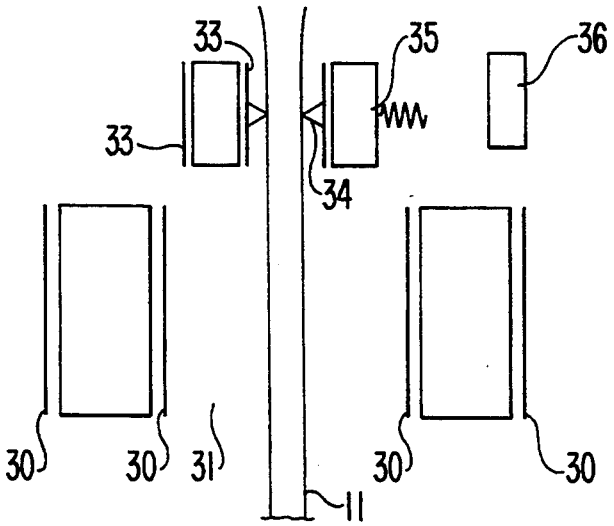

The sealing mechanism comprises two opposed stainless steel or other heat stable material belts 30 which form between them a vertical slot 31 (as shown in FIG. 4) which is to receive and grip the liner filling tube 11 for transport through the sealing station. The faces of the belts 30 can have raised ribs or the like to assist the gripping of the filling tube. One or more guide members 40 can be provided to assist feeding of the filling tube 11 into the entry of the nip or slot between the belts 30. Located above the belts 30 are two opposed elongated hot air nozzles 32 which direct a stream of hot air onto the material of the filling tube 11 so as at least partially to fuse the material of the filling tube along a band across the filling tube as the filling tube is carried past the nozzles 32 by the transport belts 30. Also located above the belts 30 are one or more opposed pressure rollers or belts 33 which apply pressure to the heated material of the filling tube 11 as it leaves the heater nozzles 32 so as to complete the formation of the heat seal across the width of the filling tube 11.

The temperature of the hot air, the nip gap between the transport belts 30 and the pressure rollers or belts 33 and the pressure applied by the pressure rollers or belts 33 can all be adjusted to suit a given design of filling tube, and the optimum operation of the sealing mechanism can be achieved by trial and error tests. The speed of travel of the belts 30 is maintained at substantially the speed of travel of the conveyor 13 so that the filling tube travels through the gap between the heating nozzles and pressure rollers or belts without any significant bunching or dragging.

The heating rollers or belts 33 can have longitudinal ribs 34 as shown in FIG. 4 which act to localize the pressure applied to the heated filling tube material and thus assist formation of the heat seal. If desired, the pressure rollers or belts 33 can be urged towards one another, for example by means of spring loaded support plates 35 which bear against the rear faces of the pressure belts to accommodate variations in the thickness of the filling tube wall material. The pressure rollers or the rearward faces of the pressure belts can be heated, for example by one or more hot air heaters or IR heaters 36 so that as the filling tube 11 is clamped between the pressure rollers or belts 33 it is heated to maintain the elevated temperature of the filling tube and thus assist formation of the heat seal across the width of the filling tube. If desired, the pressure belts 33 can be perforated so as to permit passage of air across the plane of the belt to aid heating of the material of the filling tube by direct contact with the hot air blast.

The transport belts 30 and the pressure belts 33 are supported and driven by vertical rollers which are driven in conformity with the forward carriage of the FIBC by the conveyor 13, for example by a suitable belt or chain drive from a common motive power source (not shown).

In place of the separate heating and pressure application means described above, the heat and pressure required to form the heat seal across the width of the filling tube can be applied simultaneously by means of apertured belts similar to belts 33 described above, with the sole heating air passing through the apertures.

In operation, the above sealing system reduces the stop/go travel of the FIBC and releases the operator from some of the supervision of the FIBC during the sealing cycle, thus allowing him to secure a new FIBC to the filling station as soon as the first FIBC is discharged from the filling station. The method of the invention may enable the filling and sealing cycles to be carried out by a single operator rather than the two operators hitherto required with conventional bag filling and static bar heat sealer mechanisms.

I claim:

1. A method of filling particulate material from a container through a filling duct into a liner of a FIBC, said method comprising:

providing said container with inclined surfaces converging downwardly to an outlet from said container;

providing an axial valve body at a position upstream of said outlet to mask at least a part of a direct axial flow path of particulate material to said outlet and to define therewith an annular outlet orifice;

flowing said particulate material from said container along said inclined surfaces and through said annular outlet orifice, thereby creating a free fall therefrom of said particulate material through said filling duct and into said liner as a laminar flow stream spaced from and not in contact with a wall of said filling duct throughout substantially all of its passage therethrough, and thereby defining an air passage adjacent said flow stream; and allowing air from the interior of said liner, upon being displaced therefrom by particulate material introduced therein, to escape through said air passage without significantly disrupting said flow stream.

2. A method as claimed in claim 1, comprising creating said laminar flow stream as substantially circular in cross section.

3. A method as claimed in claim 2, comprising defining said air passage as a circularly annular gap between said flow stream and said wall of said filling duct.

4. A method as claimed in claim 1, comprising defining said air passage as an annular gap between said flow stream and said wall of said filling duct.

5. A method as claimed in claim 1, comprising varying the size of said annular outlet orifice.

6. A method as claimed in claim 5, wherein said varying comprises moving said valve body axially relative to said container.

7. A method as claimed in claim 1, comprising defining by said inclined surfaces a cone having an included angle of from 20° to 80°.

8. A method as claimed in claim 1, further comprising, after said liner is filled with particulate material, moving the thus filled FIBC to a sealing station and thereat heat sealing an integral filling tube of said liner by heat sealing members moving with said FIBC.

9. A method as claimed in claim 8, wherein said sealing comprises passing said filling tube between said sealing members, and applying heat and pressure to said filling tube from said sealing members, thereby fusing said filling tube and sealing said liner.

10. An apparatus for use in supplying particulate material through a filling duct into a liner of a FIBC to thereby fill the liner, said apparatus comprising:

a container to contain particulate material and having an outlet for discharge of particulate material to the filling duct;

an axial valve body located at a position upstream of said outlet to mask as least a part of a direct axial flow path of particulate material to said outlet, said valve body defining with said outlet an annular outlet orifice; and said container having inclined surfaces converging downwardly to said outlet at an angle such that, in cooperation with said position of said valve body, as particulate material flows along said inclined surfaces and through said annular outlet orifice, such particulate material will be caused to free fall therefrom through the filling duct and into the liner as a laminar flow stream spaced from and not in contact with a wall of the filling duct throughout substantially all of its passage therethrough, thereby defining an air passage adjacent the flow stream, and air from the interior of the liner, upon being displaced therefrom by particulate material introduced therein, will be allowed to escape through the air passage without significantly disrupting the flow stream.

11. An apparatus as claimed in claim 10, wherein said outlet and said valve body are round.

12. An apparatus as claimed in claim 10, wherein said valve body is mounted for adjustment axially relative to said container.

13. An apparatus as claimed in claim 10, wherein said angle is from 20° to 80°.

14. An apparatus as claimed in claim 10, further comprising means for, after the liner is filled with particulate material, moving the thus filled FIBC to a sealing station and thereat heat sealing an integral filling tube of the liner by heat sealing members movable with the FIBC.

15. An apparatus as claimed in claim 14, wherein said sealing members are constructed to apply heat and pressure to the filling tube, thereby fusing the filling tube and sealing the liner.

16. An apparatus for filling particulate material into a liner of a FIBC, said apparatus comprising:

a filling duct to be introduced into the liner to guide the introduction thereinto of particulate material;

a container to contain particulate material and having an outlet for discharge of particulate material to said filling duct;

an axial valve body located at a position upstream of said outlet to mask as least a part of a direct axial flow path of particulate material to said outlet, said valve body defining with said outlet an annular outlet orifice; and said container having inclined surfaces converging downwardly to said outlet at an angle such that, in cooperation with said position of said valve body, as particulate material flows along said inclined surfaces and through said annular outlet orifice, such particulate material will be caused to free fall therefrom through said filling duct and into the liner as a laminar flow stream spaced from and not in contact with a wall of said filling duct throughout substantially all of its passage therethrough, thereby defining an air passage adjacent the flow stream, and air from the interior of the liner, upon being displaced therefrom by particulate material introduced therein, will be allowed to escape through the air passage without significantly disrupting the flow stream.

17. An apparatus as claimed in claim 16, wherein said outlet and said valve body are round.

18. An apparatus as claimed in claim 16, wherein said valve body is mounted for adjustment axially relative to said container.

19. An apparatus as claimed in claim 16, wherein said angle is from 20° to 80°.

20. An apparatus as claimed in claim 16, further comprising means for, after the liner is filled with particulate material, moving the thus filled FIBC to a sealing station and thereat heat sealing an integral filling tube of the liner by heat sealing members movable with the FIBC.

21. An apparatus as claimed in claim 20, wherein said sealing members are constructed to apply heat and pressure to the filling tube, thereby fusing the filling tube and sealing the liner.

* * * * *